US007083529B2

(12) United States Patent
Cackett et al.

(10) Patent No.: US 7,083,529 B2
(45) Date of Patent: Aug. 1, 2006

(54) GOLF CLUB WITH INTERCHANGEABLE HEAD-SHAFT CONNECTIONS

(75) Inventors: Matthew T. Cackett, San Diego, CA (US); Alan Hocknell, Encinitas, CA (US); Steven S. Ogg, Carlsbad, CA (US); Konrad Lenhof, Vista, CA (US); Jerry V. Blanke, Murrieta, CA (US); Joel B. Erickson, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 10/904,581

(22) Filed: Nov. 17, 2004

(65) Prior Publication Data

US 2006/0105855 A1 May 18, 2006

(51) Int. Cl.
*A63B 53/02* (2006.01)

(52) U.S. Cl. ..... 473/309; 473/310

(58) Field of Classification Search ..... 473/305–311
See application file for complete search history.

(56) References Cited

U.S. PATENT DOCUMENTS

| | | | | |
|---|---|---|---|---|
| 2,020,679 | A * | 11/1935 | Fitzpatrick | 473/310 |
| 3,524,646 | A | 8/1970 | Wheeler | |
| 4,948,132 | A | 8/1990 | Wharton | |
| 5,039,098 | A * | 8/1991 | Pelz | 473/306 |
| 5,133,553 | A | 7/1992 | Divnick | |
| 5,184,819 | A | 2/1993 | Desbiolles | |
| 5,433,442 | A | 7/1995 | Walker | |
| 5,513,844 | A | 5/1996 | Ashcraft et al. | |
| 5,527,034 | A | 6/1996 | Ashcraft et al. | |
| 5,722,901 | A | 3/1998 | Barron et al. | |
| 5,851,155 | A | 12/1998 | Wood et al. | |
| 5,863,260 | A | 1/1999 | Butler, Jr. et al. | |
| 5,885,170 | A | 3/1999 | Takeda | |
| 5,951,411 | A * | 9/1999 | Wood et al. | 473/307 |
| 6,149,533 | A | 11/2000 | Finn | |
| 6,273,828 | B1 | 8/2001 | Wood et al. | |
| 6,514,154 | B1 | 2/2003 | Finn | |
| 6,547,673 | B1 | 4/2003 | Roark | |
| 6,620,053 | B1 * | 9/2003 | Tseng | 473/297 |
| 6,769,996 | B1 | 8/2004 | Tseng | |
| 2004/0018886 | A1 | 1/2004 | Burrows | |
| 2004/0018887 | A1 | 1/2004 | Burrows | |

* cited by examiner

*Primary Examiner*—Stephen Blau
(74) *Attorney, Agent, or Firm*—Michael A. Catania; Elaine H. Lo

(57) ABSTRACT

A golf club (20) having a club head (22) with an interchangeable shaft (40) is disclosed herein. The golf club (20) includes a tube (44, 144) mounted in the club head (22), and a sleeve (46, 146) mounted on a tip end (50) of the shaft (40). The tube (44, 144) includes a tapered portion (60, 160) and a rotation prevention portion (62, 162). The sleeve (46, 146) has a frustoconical portion (72, 172) and a keyed portion (74, 174) that are respectively received in the tapered portion (60, 160) and the rotation prevention portion (62, 162) of the tube (44, 144). The golf club (20) further includes a mechanical fastener (48, 148) for removably securing the shaft (40) to the club head (22).

27 Claims, 4 Drawing Sheets

GOLF CLUB WITH INTERCHANGEABLE HEAD-SHAFT CONNECTIONS

BACKGROUND OF THE INVENTION

1. Field of the Invention

The present invention relates to a golf club having an improved connection for interchanging a shaft with a golf club head.

2. Description of the Related Art

In order to improve their game, golfers often customize their equipment to fit their particular swing. Golf equipment manufacturers have responded by increasing the variety of clubs available to golfers. For example, a particular model of a driver-type golf club may be offered in several different loft angles and lie angles to suit a particular golfer's needs. In addition, golfers can choose shafts, whether metal or graphite, and adjust the length of the shaft to suit their swing. Golf clubs that allow shaft and club head components to be easily interchanged facilitate this customization process.

One example is Wheeler, U.S. Pat. No. 3,524,646 for a Golf Club Assembly. The Wheeler patent discloses a putter having a grip and a putter head, both of which are detachable from a shaft. Fastening members, provided on the upper and lower ends of the shaft, have internal threads, which engage the external threads provided on both the lower end of the grip and the upper end of the putter head shank to secure these components to the shaft. The lower portion of the shaft further includes a flange, which contacts the upper end of the putter head shank, when the putter head is coupled to the shaft.

Another example is Walker, U.S. Pat. No. 5,433,442 for Golf Clubs with Quick Release Heads. The Walker patent discloses a golf club in which the club head is secured to the shaft by a coupling rod and a quick release pin. The upper end of the coupling rod has external threads that and engage the internal threads formed in the lower portion of the shaft. The lower end of the coupling rod, which is inserted into the hosel of the club head, has diametric apertures that align with diametric apertures in the hosel to receive the quick release pin.

Still another example is Roark, U.S. Pat. No. 6,547,673 for an Interchangeable Golf Club Head and Adjustable Handle System. The Roark patent discloses a golf club with a quick release for detaching a club head from a shaft. The quick release is a two-piece connector including a lower connector, which is secured in the hosel of the club head, and an upper connector, which is secured in the lower portion of the shaft. The upper connector has a pin and a ball catch that protrude radially outward from the lower end of the upper connector. The upper end of the lower connector has a slot formed therein for receiving the upper connector pin, and a separate hole for receiving the ball catch. When the shaft is coupled to the club head, the lower connector hole retains the ball catch to secure the shaft to the club head.

Two further examples are published applications to Burrows, U.S. Pub. Nos. 2004/0018886 and 2004/0018887, both of which are for a Temporary Golf Club Shaft-Component Connection. The Burrows applications disclose a temporary connection that includes an adapter insert, a socket member, and a mechanical fastener. The adapter insert, which is mounted on a shaft, includes a thrust flange. The socket member, which is mounted on the other golf club component (e.g., a club head), includes a thrust seat for seated reception of the thrust flange. The mechanical fastener (e.g., a compression nut or a lock bolt) removably interconnects the adapter insert and the socket member.

The prior art temporary head-shaft connections have several disadvantages. First, they require that the golf club head have a conventional hosel for attachment. Second, these connections add excessive weight to the club head, thereby minimizing the amount of discretionary mass that may be distributed in the club head to optimize mass properties. Third, the prior art connections offer small, faying surfaces for centering and reacting to bending moments.

BRIEF SUMMARY OF THE INVENTION

The present invention provides an improved club head-shaft connection for cost-effective customization of golf clubs, while providing golfers with golf clubs that provide optimal performance. The connection, which does not require the club head to have a conventional hosel, enables quick and reliable assembly and disassembly of a shaft from the club head. In addition, the head-shaft connection of the present golf club provides a larger faying surface between the components without adding excessive weight. The reduced weight of the present connection enables more discretionary mass to be distributed to favorable locations in the club head to enhance its performance.

One aspect of the present invention is a golf club including a club head, a tube, a shaft, a sleeve and a mechanical fastener. The tube, which is mounted in the club head, has a tapered portion, a rotation prevention portion, and an upper end inner diameter that is larger than the inner diameter at the lower end. The rotation prevention portion of the tube defines a keyway that has a non-circular configuration. The sleeve is mounted on a tip end of the shaft, which is then inserted into the tube. A lower section of the sleeve includes a frustoconical portion and a keyed portion. When the shaft is connected to the club head, the frustoconical portion and keyed portion of the sleeve are respectively received in the tapered portion and keyway portion of the tube. The frustoconical portion of the sleeve extends at least a quarter of the length of the lower section of the tube to provide an increased surface area for contact with the tapered portion of the tube.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
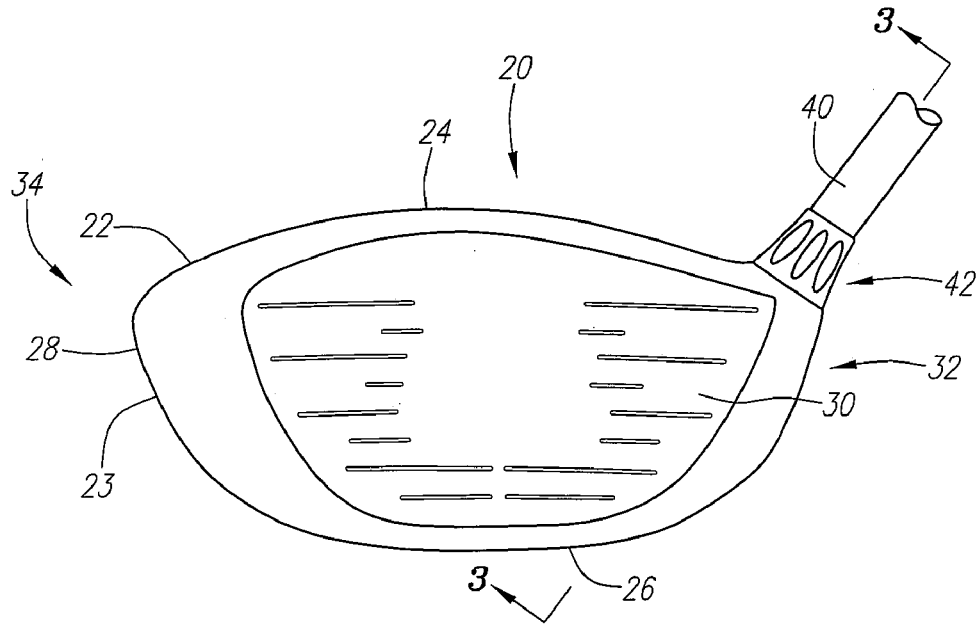
FIG. 1 is a front plan view of a golf club in accordance with one embodiment of the present invention.
Figure 2:
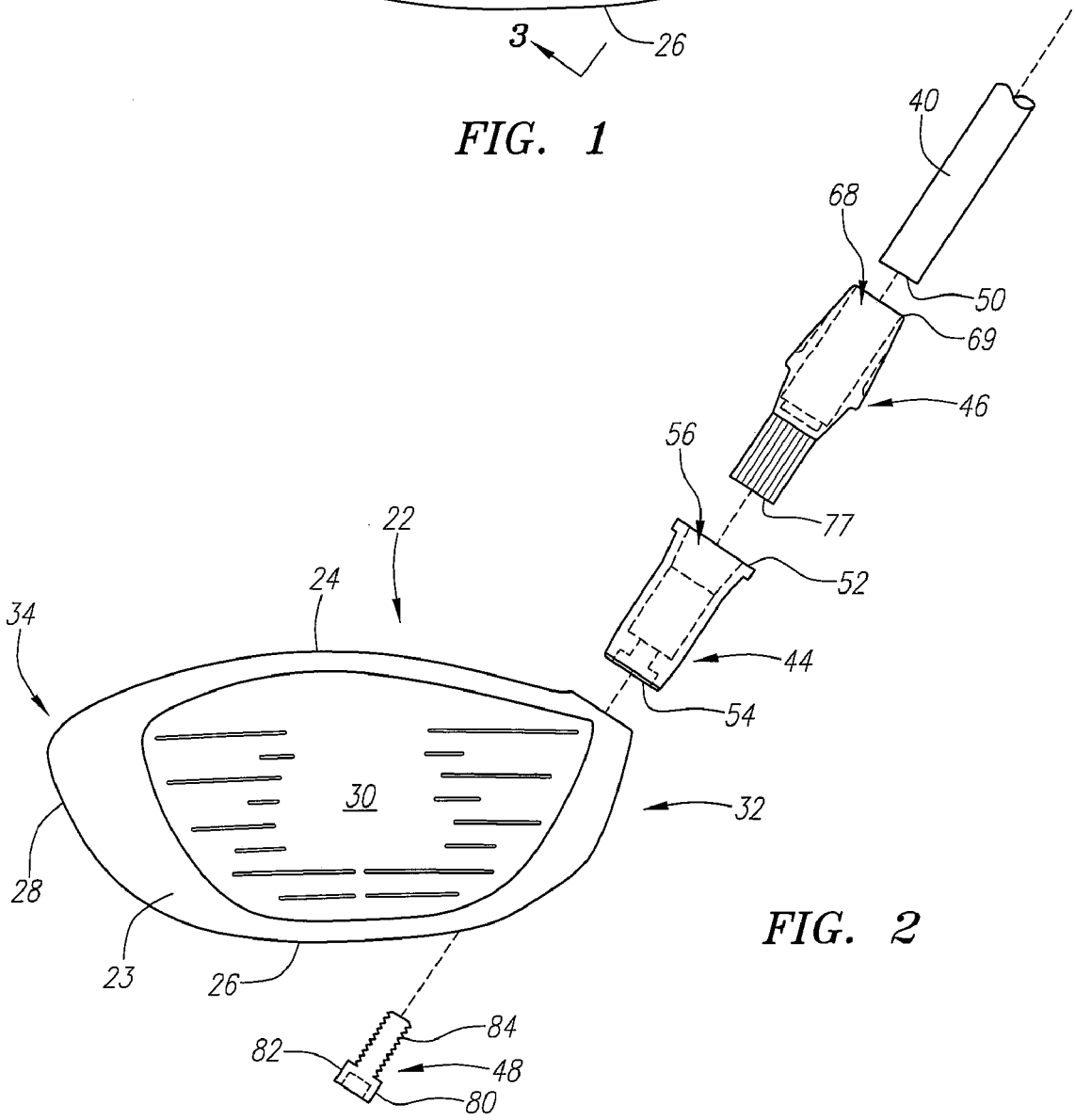
FIG. 2 is an exploded perspective view of a portion of the golf club of FIG. 1 illustrating the components of the head-shaft connection, including a sleeve, a tube, and a mechanical fastener.

As shown in FIGS. 1 and 2, a golf club is generally designated 20. The golf club 20 has a club head 22 and a shaft 40 that is coupled to the club head 22. The club head 22 is a wood-type golf club head with a body 23 having a crown, 24, a sole 26, a ribbon 28 and a striking plate 30. The striking plate 30 generally extends along the front of the club head 22 from a heel end 32 to a toe end 34. The club head body 23 preferably has a hollow interior with an internal hosel 31 (FIG. 3) for receiving the tip end of the shaft 40.

The body 23 is preferably composed of a metallic material, such as titanium, titanium alloy, stainless steel, or the like. Alternatively, the body 23 may be composed of multiple materials, such as a titanium face cup attached to a carbon composite body. The body 23 has a large volume, preferably greater than 300 cubic centimeters, and weighs no more than 215 grams, more preferably between 180 and 215 grams. Although the club head 22 illustrated is a wood-type club head, the club head 22 may also be an iron-type or putter-type club head.

The shaft 40 is preferably composed of a graphite material, however, it may be composed of a metallic material, such as stainless steel or titanium. Alternatively, the shaft 40 may be composed of a hybrid of graphite and metal. The shaft 40 preferably weighs between 40 grams and 80 grams, more preferably between 50 grams and 75 grams, and is most preferably 65 grams.

The shaft 40 is coupled to the club head 22 using a connection 42 that provides for easy assembly, disassembly and reassembly, thereby facilitating customization of the golf club 20. In a preferred embodiment of the invention illustrated in FIGS. 2 and 3, the connection 42 includes a tube 44, a sleeve 46 and a mechanical fastener 48. The sleeve 46 is mounted on a tip end 50 of the shaft 40. The shaft 40 with the sleeve 46 mounted thereon is then inserted in the tube 44, which is mounted in the club head 22. The mechanical fastener 48 secures the sleeve 46 to the tube 44 to retain the shaft 40 in connection with the club head 22.

The tube 44 is preferably composed of a metallic material, such as aluminum or titanium, but may also be composed of a suitable non-metallic material. The tube 44 is preferably treated with an anodizing or tiodizing process to improve the surface hardness and wear resistant properties of the tube 44. The tube 44 may be secured in the internal hosel 31 of the club head 22 using an adhesive, such as epoxy. Alternatively, the tube 44 may be integrally cast or formed with the body 23 of the club head 22. The tube 44 has an upper end 52 that is substantially flush with the exterior surface of the crown 24 of the club head 22 and a lower end 54 that extends toward, but not all the way down to, the sole 26 of the club head 22. An opening 56 extends through the tube 44 from the upper end 52 to the lower end 54 and aligns with an opening 58 in the sole 26.

Figure 3:
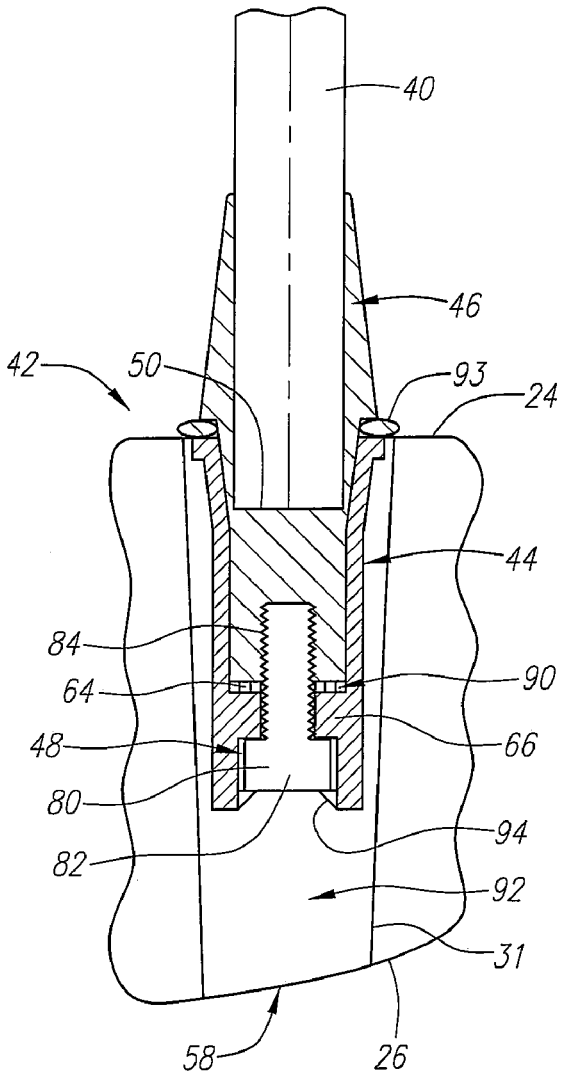
FIG. 3 is an enlarged cross-sectional view taken generally along the line 3—3 in FIG. 1.
Figure 4:
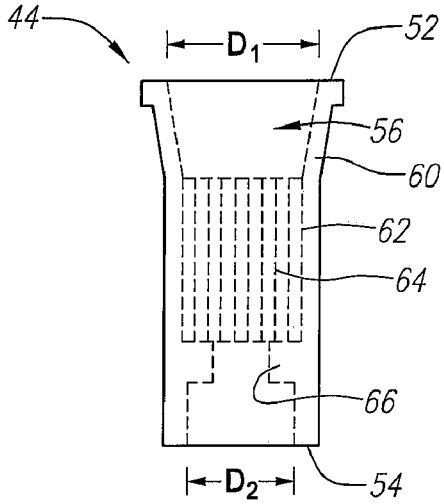
FIG. 4 is an enlarged cross-sectional view of the tube shown in FIG. 2.

As best illustrated in FIG. 4, the tube 44 includes a tapered portion 60 and a rotation prevention portion 62. The tapered portion 60 is located proximate the upper end 52 of the tube 44 and provides a contact surface for receiving the sleeve 46, as will be described in greater detail below. The upper end 52 of the tube 44, therefore, has an inner diameter $D_1$ that is larger than an inner diameter $D_2$ of the lower end 54. The rotation prevention portion 62, which is preferably located below the tapered portion 60, defines a keyway for receiving a portion of the sleeve 46. The keyway has a non-circular cross-section to prevent rotation of the sleeve 46 relative to the tube 44. The keyway may have a plurality of splines 64, as illustrated in FIGS. 3 and 4, or a rectangular or hexagonal cross-section.

The tube 44 further includes a flange 66 that projects radially inward from the sidewall of the tube 44. In the preferred embodiment, the flange 66 is located below the rotation prevention portion 62. The flange 66 provides a surface against which a portion of the mechanical fastener 48 rests. The flange 66 extends into the opening 56 a sufficient distance to prevent the entire mechanical fastener 48 from passing through, while allowing a portion of the mechanical fastener 48 to extend into the rotation prevention portion 62.

Figure 5:
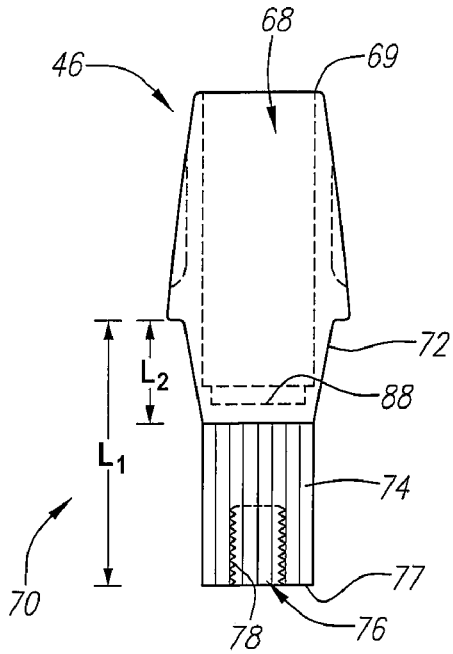
FIG. 5 is an enlarged cross-sectional view of the sleeve shown in FIG. 2.

The sleeve 46, which is best illustrated in FIG. 5, has an opening 68 formed in an upper end 69 thereof for receiving the tip end 50 of the shaft 40. The sleeve 46 is fixedly secured to the shaft 40 using an adhesive, such as epoxy. The sleeve 46 has a lower section 70 that includes a frustoconical portion 72 and a keyed portion 74. The lower section 70 has a length $L_1$ that is preferably between 0.60 inch and 1.0 inch, more preferably between 0.75 inch and 0.90 inch. The frustoconical portion 72 of the sleeve 46 is received in the tapered portion 60 of the tube 44 when the shaft 40 is coupled to the club head 22. The frustoconical portion 72 preferably has a length $L_2$ that is a least one quarter of the length $L_1$ of the lower section 76, more preferably at least one third of the length $L_1$. In one embodiment of the invention, the length $L_1$ of the lower section 70 is approximately 0.8 inch, and the length $L_2$ of the frustoconical portion 72 is approximately 0.3 inch. The longer length $L_2$ of the frustoconical portion 72 provides a greater the contact area with the tapered portion 60 of the tube 44. This region is the compressive load path between the shaft 40 and the club head 22. Because of the larger contact area between the frustoconical portion 72 and the tapered portion 60, there are less localized stresses, and the connection 42 is better able to react to bending moments than prior art connections. In addition, one or both of the surfaces of the tapered portion 60 and the frustoconical portion 72 may be coated with an elastomeric material or other soft, thin material to enhance an even load distribution.

The keyed portion 74 of the sleeve 46 has a configuration that is complementary to the keyway of the rotation prevention portion 62 of the tube 44. Thus, in FIG. 5, the keyed portion 74 has a splined configuration. Alternatively, the keyed portion 74 may have a rectangular or hexagonal configuration, similar to that of the corresponding keyway.

The sleeve 46 has a second opening 76 formed in a lower end 77 thereof. The opening 76 is formed with internal threads 78 for engagement with external threads on the mechanical fastener 48. The sleeve 46 is preferably composed of a metallic material, such as aluminum or titanium. The sleeve 46 is preferably treated with an anodizing or tiodizing process to improve the surface hardness and wear resistant properties of the sleeve 46. A steel liner with internal threads (not shown) may be provided in the opening 76 for improved wear. Such a steel liner may include a HELI-COIL screw thread insert from Emhart Teknologies or a KEENSERTS insert from Alcoa Fastening Systems.

Assembly of the golf club 20 includes permanently securing the tube 44 to the club head 22, and the sleeve 46 to the tip end 50 of the shaft 40. The tip end 50 of the shaft 40 with the sleeve 46 mounted thereon is then inserted into the opening 56 of the tube 44, such that the keyed portion 74 of the sleeve 46 engages the keyway of the tube's rotation prevention portion 62, and the frustoconical portion 72 is in contact with the tapered portion 60. The mechanical fastener 48 is then connected to the sleeve 46. The mechanical fastener 48 is preferably composed of steel, titanium or aluminum. As shown in FIGS. 2 and 3, the mechanical fastener 48 is a screw, such as a socket screw 80 having a socket head 82 and external threads 84. The socket screw 80 is inserted into the lower end 54 of the tube 44 through the opening 58 in the sole 26 of the club head 22. The external threads 84 of the socket screw 80 engage the internal threads 78 in the opening 76 at the lower end 77 of the sleeve 46, while the socket head 82 abuts the flange 66 of the tube 44. An anti-vibration lock-washer (not shown) may be provided between the socket head 82 and the flange 66 to prevent loosening or rattling of the socket screw 80.

Because the tube 44 and the sleeve 46 are composed of lightweight materials, the connection 42 does not add unnecessary weight to the golf club 20. Further, voids between the various components exist to further reduce weight from this region of the club head 22. A first void 90 is located between the lower end 77 of the sleeve 46 and the flange 66 of the tube 44. A second void 92 is located between the mechanical fastener 48 and the lower end 54 of the tube 44. The voids 90 and 92 decrease the weight of connection 42, thereby providing more discretionary mass that may be distributed to favorable positions along club head 22.

The golf club 20 may further include a sealing gasket 93, such as an O-ring, to prevent the ingress of water, dirt or other contaminants into the connection 42. This is important, since the club head 22 may be submerged in water for purposes of cleaning. Without the sealing gasket 93, water could enter into the threaded joint and result in corrosion or freezing of the threads.

The head-shaft connection 42 allows the shaft 40 to be detached from the club head 22 and replaced with a different shaft. To disassemble the golf club 20, the socket screw 80 is unscrewed from the sleeve 46 and removed through the opening 58 in the sole 26 of the club head 22. The shaft 40 and sleeve 46 may then be lifted out of the upper end 52 of the tube 44 and separated from the club head 22. A second shaft and sleeve assembly may then be coupled to the club head 22.

When a suitable club head and shaft combination is achieved, the connection 42 may be made more permanent by applying a bead 94 of adhesive about the head 82 of the socket screw 80. This adhesive bead 94 would prevent the average golfer from disassembling the golf club 20 and interchanging components, thereby enabling the golf club 20 to conform to the USGA and R&A rules of golf. A skilled golf repair technician, however, would still be able to disassemble the golf club by applying heat locally to the joint. One of ordinary skill in the art will appreciate that alternatives to the adhesive bead 94 may also be employed. One example is an adhesive washer that is applied between the screw head 82 and the flange 66. Another example is a sleeve of adhesive that is applied about the surface of the screw head 82, thereby bonding the socket screw 80 to the interior surface of the tube 44. Still another example is a plug that is inserted into the opening 56 after the socket screw 80. The plug, which engages the screw's socket, is the bonded to interior surface of the tube 44 using an adhesive.

FIGS. 6–9 illustrate a golf club with an alternative connection 142 for joining a shaft 40 to a club head 22. The connection 142 includes a tube 144, a sleeve 146 and a mechanical fastener 148. The mechanical fastener 148 is a compression nut 96 having external threads 98. The compression nut 96 and the sleeve 146 are placed on the shaft 40, with the sleeve 146 mounted on the tip end 50 and secured thereto with an adhesive, such as epoxy. The shaft 40 with the sleeve 146 and compression nut 96 thereon is then inserted into the tube 144, which is mounted in the club head 22. The compression nut 96 is then tightened to engage the tube 144, thereby securing the sleeve 146 inbetween and connecting the shaft 40 to the club head 22.

The tube 144 is preferably composed of a metallic material, such as aluminum or titanium, but may also be composed of a suitable non-metallic material. The tube 144 is secured in the internal hosel 31 of the club head 22 using an adhesive, such as epoxy. The tube 144 has an upper end 152 that extends above the crown surface 24 of the club head 22. Alternatively, the upper end 152 of the tube 144 may be flush with the crown surface 24. An opening 156 extends along a majority of the length of the tube 144 from the upper end 152 toward a lower end 154. The lower end 154 of the tube 144, however, is closed. The inner diameter $D_1$ of the upper end 152 of the tube 144 is greater than the inner diameter $D_2$ at the lower end 154.

Figure 8:
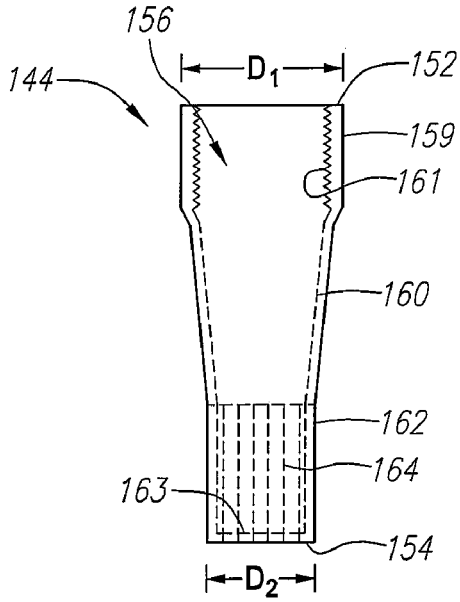
FIG. 8 is an enlarged cross-sectional view of the tube shown in FIG. 6.

The tube 144, as illustrated in FIG. 8, includes a connection portion 159, a tapered portion 160 and a rotation prevention portion 162. The connection portion 159 is located proximate the upper end 152 of the tube 144 and has internal threads 161 for engaging the external threads 98 of the compression nut 96. Because the threads 161 of tube 144 are internal, the threads 161 are protected from damage that may occur during storage, manufacture, or customization of the golf club 20.

The tapered portion 160, which provides a contact surface for receiving the sleeve 146, is located below the connection portion 159. The rotation prevention portion 162 is located proximate the lower end 154 of the tube 144 and defines a keyway for receiving a portion of the sleeve 146. As with the previous embodiment, the keyway has a non-circular cross-section to prevent rotation of the sleeve 146 relative to the tube 144. The keyway of the rotation prevention portion 162 illustrated in FIGS. 7 and 8 is provided with splines 164.

Figure 9:
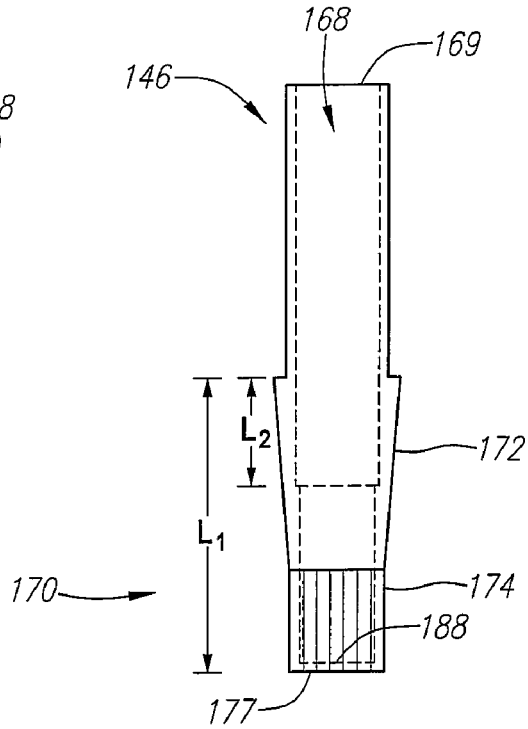
FIG. 9 is an enlarged cross-sectional view of the sleeve shown in FIG. 6.

The sleeve 146 is illustrated in FIG. 9. The sleeve has an opening 168 formed in an upper end 169 thereof for receiving the tip end 50 of the shaft 40. The sleeve is fixedly secured to the shaft 40 using an adhesive, such as epoxy. The sleeve 146 has a lower section 170 that includes a frustoconical portion 172 and a keyed portion 174. The frustoconical portion 172 has a length $L_2$ that is at least one quarter of the length $L_1$ of the lower section 170, more preferably at least one third of the length $L_1$, and may be more than half the length $L_1$. The longer length $L_2$ of the frustoconical portion 172 provides a greater contact area with the tapered portion 160 of the tube 144. The keyed portion 174 of the sleeve 146 is configured to complement the keyway of the tube's rotation prevention portion 162. Thus, the illustrated keyed portion 174 has a splined configuration.

Figure 6:
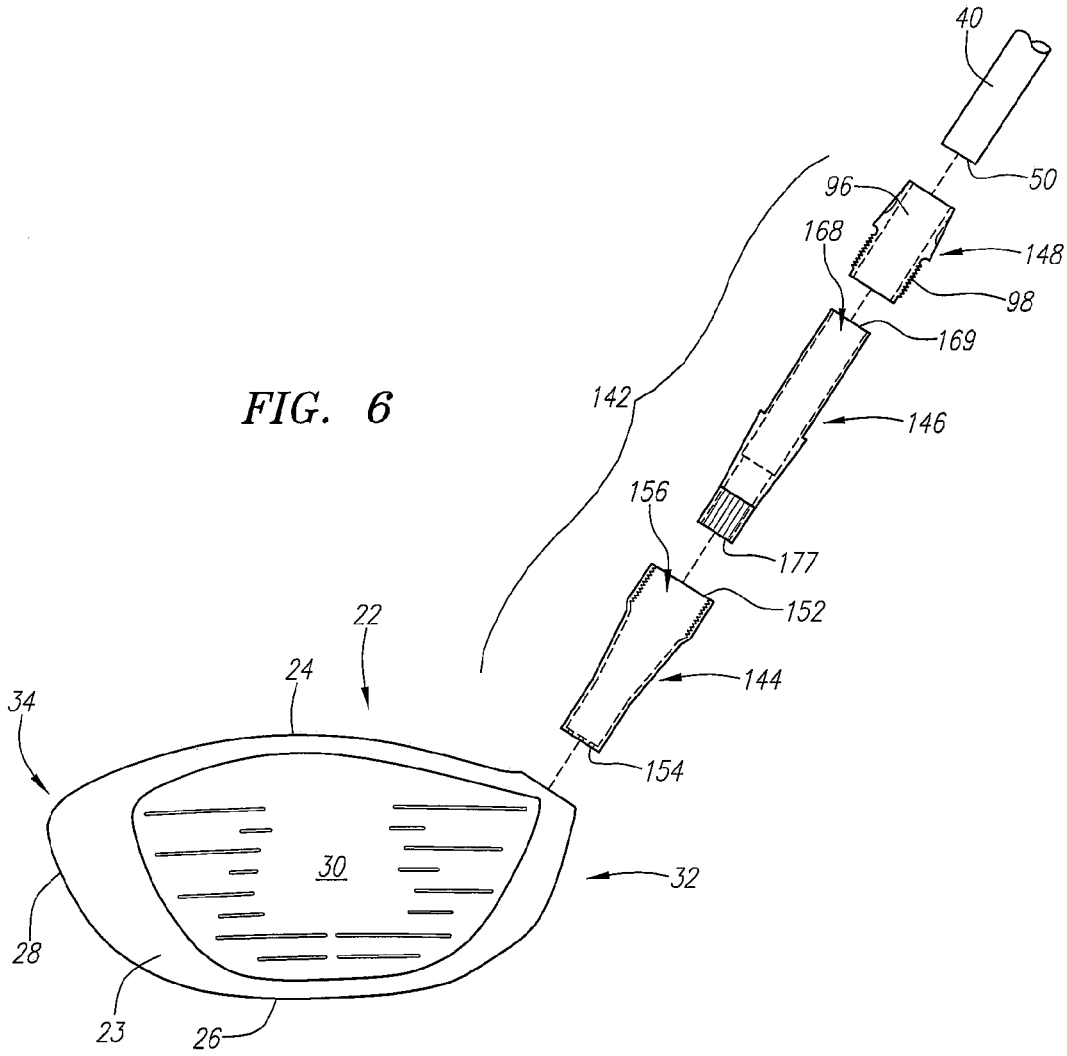
FIG. 6 is an exploded perspective view of a portion of a golf club in accordance with another embodiment of the present invention.
Figure 7:
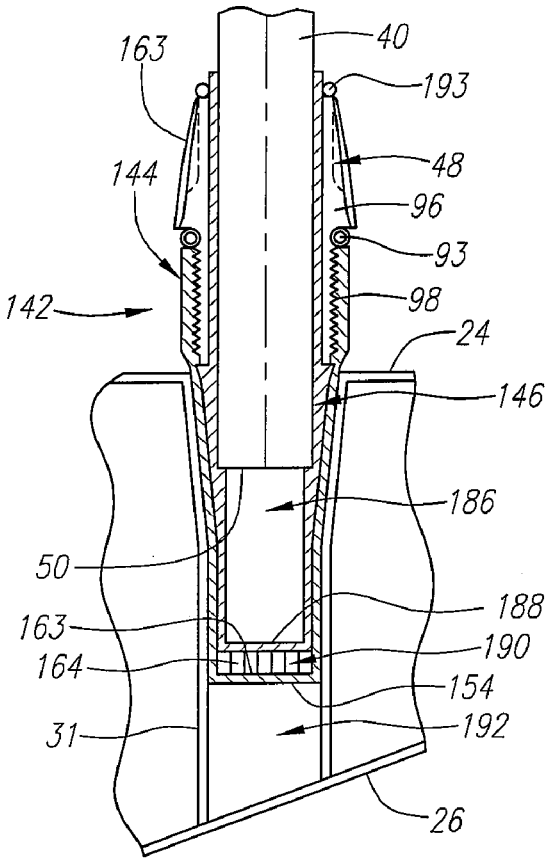
FIG. 7 is an enlarged cross-sectional view similar to FIG. 3, but of the golf club of FIG. 6.

The golf club illustrated in FIGS. 6 and 7 is assembled by permanently securing the tube 144 to the club head 22. Next, the compression nut 96 is placed over the tip end 50 of the shaft 40. The sleeve 146 is then permanently secured to the tip end 50 of the shaft 40. The tip end 50 of the shaft 40, carrying the sleeve 146 and the compression nut 96, is then inserted into the opening 156 in the tube 144, such that the keyed portion 174 of the sleeve 146 engages the keyway of the tube's rotation prevention portion 162, and the frustoconical portion 172 is in contact with the tapered portion 160. The external threads 98 of the compression nut 96 are then engaged with the internal threads 161 of the connection portion 159 of the tube 144 to secure the shaft 40 to the club head 22.

As with the previous embodiment, the tube 144 and the sleeve 146 are composed of lightweight materials that do not add unnecessary weight to the golf club. In addition, voids are provided in the connection 142 to further reduce weight from this region of the club head 22. A first void 186 is located between the tip end 50 of the shaft 40 and a bottom surface 168 of the opening 188 in the sleeve 146. A second void 190 is located between the lower end 177 of the sleeve 146 and a bottom surface 163 of the opening 156 in the tube 144. A third void 192 is located between the lower end 154 of the tube 144 and the sole 26 of the club head 22.

The golf club may further include a sealing gasket 93 located between the compression nut 96 and the upper end 152 of the tube 144 to prevent water and other contaminants from entering the connection 142. A second gasket 193 may also be provided between the top of the compression nut 96 and the upper end 169 of the sleeve 146 for aesthetic purposes.

When a suitable head and shaft combination is achieved, the connection 142 may be made more permanent, by applying a cover 163 over the exposed portion of the compression nut 96. The cover 163 is preferably a thin sheath of rubber or elastomeric material that encloses the indents on the compression nut 96, making the compression nut 96 inaccessible to the average golfer. The cover 163 may be integral with the sealing gaskets 93 and 193 or separate. The connection 142 may also be made more permanent by extending the lower edge of the head of the compression nut 96 over the sealing gasket 93 to overlap the outer wall of the upper end 152 of the tube 144, and applying a bead of adhesive at the overlap. Local application of heat to this joint by a skilled golf repair technician would enable the compression nut 96 to be separated from the tube 144 and a different shaft to be combined with the club head.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

What is claimed is:

1. A golf club comprising:

a club head;

a tube mounted in the club head, the tube having an upper end with an inner diameter larger than an inner diameter at a lower end of the tube, the tube including a tapered portion and a rotation prevention portion, the rotation prevention portion defining a keyway having a non-circular configuration;

a shaft having a tip end removably mounted in the tube in the club head;

a sleeve mounted on the tip end of the shaft and disposed between the shaft and the tube, a lower section of the sleeve including a frustoconical portion, a keyed portion and a lower end of the sleeve, the frustoconical portion extending along at least a quarter of the length of the lower section, the frustoconical portion being received in the tapered portion of the tube, the keyed portion being received in the rotation prevention portion of the tube, the keyed portion having an external configuration complementary to that of the keyway to prevent rotation of the shaft relative to the club head; and a mechanical fastener removably securing the sleeve to the tube.

2. The golf club according to claim 1, wherein the upper end of the tube is substantially flush with an exterior crown surface of the club head.

3. The golf club according to claim 1, wherein the upper end of the tube extends above an exterior crown surface of the club head.

4. The golf club according to claim 1, further comprising a sealing gasket located between the upper end of the tube and one of the mechanical fastener and the sleeve.

5. The golf club according to claim 1 wherein each of the tube and the sleeve is composed of a metallic material.

6. The golf club according to claim 1, wherein at least one of the tapered portion of the tube and the frustoconical portion of the sleeve is coated with an elastomeric material.

7. The golf club according to claim 1, wherein a lower end of the sleeve is spaced apart from the lower end of the tube.

8. The golf club according to claim 1, wherein the tip end of the shaft is inserted into an opening formed in the sleeve, the tip end of the shaft being spaced apart from a bottom surface of the opening.

9. The golf club according to claim 1, further comprising an adhesive between the mechanical fastener and the tube, the adhesive preventing removal of the mechanical fastener.

10. The golf club according to claim 1, wherein the tube is integrally formed with the club head.

11. The golf club according to claim 1, wherein the club head includes a hosel, the tube being mounted in the hosel.

12. The golf club according to claim 1, wherein the mechanical fastener is a nut having external threads, and an upper portion of the tube has internal threads for engaging the external threads of the nut.

13. The golf club according to claim 12, further comprising a cover disposed on the nut, the cover encasing an exposed surface of the nut when the nut is engaged with the tube.

14. The golf club according to claim 1, wherein the lower end of the tube is open and aligned with an opening in a sole portion of the club head.

15. The golf club according to claim 14, wherein the mechanical fastener is a socket screw having external threads, and a lower portion of the sleeve has internal threads for engaging the external threads of the socket screw, the socket screw being inserted into the opening in the sole portion of the club head.

16. The golf club according to claim 15, further comprising an adhesive between a head of the socket screw and the tube, the adhesive preventing removal of the socket screw.

17. The golf club according to claim 16, wherein a lower end of the sleeve is spaced apart from the flange.

18. The golf club according to claim 15, wherein a lower portion of the tube includes a flange, a head of the socket screw abutting the flange when the socket screw is secured to the sleeve.

19. A golf club comprising:

a club head;

a tube mounted in the club head, the tube being composed of a metallic material and having an upper end with an inner diameter larger than an inner diameter at a lower end of the tube, the tube including a tapered portion and a rotation prevention portion, the rotation prevention portion being located below the tapered portion and defining a keyway having a non-circular configuration;

a shaft having a tip end removably mounted in the tube in the club head;

a sleeve mounted on the tip end of the shaft and disposed between the shaft and the tube, the sleeve being composed of a metallic material, a lower section of the sleeve including a frustoconical portion, a keyed portion and a lower end of the sleeve, the frustoconical portion extending along at least a quarter of the length of the lower section, the frustoconical portion being received in the tapered portion of the tube, the keyed portion being received in the rotation prevention portion of the tube, the keyed portion having an external configuration complementary to that of the keyway to prevent rotation of the shaft relative to the club head; and a mechanical fastener removably securing the sleeve to the tube.

20. The golf club according to claim 19, wherein at least one of the tapered portion of the tube and the frustoconical portion of the sleeve is coated with an elastomeric material.

21. The golf club according to claim 19, wherein a lower end of the sleeve is spaced apart from the lower end of the tube.

22. The golf club according to claim 19, wherein the tip end of the shaft is inserted into an opening formed in the sleeve, the tip end of the shaft being spaced apart from a bottom surface of the opening.

23. The golf club according to claim 19, further comprising a sealing gasket located between the upper end of the tube and one of the mechanical fastener and the sleeve.

24. The golf club according to claim 19, further comprising an adhesive between the mechanical fastener and the tube, the adhesive preventing removal of the mechanical fastener.

25. The golf club according to claim 19, wherein the mechanical fastener is a nut having external threads, and an upper portion of the tube has internal threads for engaging the external threads of the nut.

26. The golf club according to claim 19, wherein the lower end of the tube is open and aligns with an opening in a sole portion of the club head, the mechanical fastener is a socket screw having external threads, and a lower portion of the sleeve has internal threads for engaging the external threads of the socket screw, the socket screw being inserted into the opening in the sole portion of the club head.

27. The golf club according to claim 26, wherein a lower portion of the tube includes a flange, a head of the socket screw abutting the flange when the socket screw is secured to the sleeve, and wherein a lower end of the sleeve is spaced apart from the flange.

* * * * *